United States Patent [19]

Wargo

[11] Patent Number: 4,703,766

[45] Date of Patent: Nov. 3, 1987

[54] CIGARETTE MOUNTED EXTINGUISHER

[76] Inventor: Joseph A. Wargo, 2701 31st Pl., NE., Washington, D.C. 20018

[21] Appl. No.: 871,888

[22] Filed: Jun. 6, 1986

[51] Int. Cl.[4] ..... A24F 13/16; A24F 13/18

[52] U.S. Cl. ..... 131/175; 131/349

[58] Field of Search ..... 131/174, 175, 187, 349, 131/256, 198.1, 198.2, 201, 225, 226, 227, 228

[56] References Cited

U.S. PATENT DOCUMENTS

| | | | |
|---|---|---|---|
| 2,823,679 | 2/1958 | Vrana | 131/174 |
| 3,827,444 | 8/1974 | Khan | 131/174 |
| 3,916,916 | 11/1975 | Bramucci | 131/175 |
| 4,289,149 | 9/1981 | Kyriakou | 131/175 |
| 4,386,616 | 6/1983 | Rosen | 131/174 |
| 4,570,645 | 2/1986 | Newman, Sr. et al. | 131/175 |
| 4,572,217 | 2/1986 | Newman, Sr. et al. | 131/175 |
| 4,579,128 | 4/1986 | Ball | 131/175 |

*Primary Examiner*—V. Millin
*Assistant Examiner*—H. Macey
*Attorney, Agent, or Firm*—Fleit, Jacobson, Cohn & Price

[57] ABSTRACT

A lightweight cylindrical body is provided constructed of heat resistant and medium heat conducting material such as tetrafluoroethylene and the body is slightly longer than a companion cigarette having the ignited end thereof frictionally telescoped into one end of the body to a position with the ignited end spaced inward of the second end of the tubular body and the end of the cigarette remote from the ignited end projecting outward of the aforementioned one end of the tubular body. The second end of the tubular body includes radial bores spaced circumferentially thereabout and longitudinally therealong. The ignited end of the cigarette is spaced inward of the radial bores and the tubular body serves to restrict the free flow of combustion supporting air to the ignited end of the cigarette when a smoker is not drawing upon the cigarette and also to conduct, at a medium rate, the heat of combustion of the ignited end of the cigarette through the walls of the tubular body to the external surfaces thereof for dissipation in the ambient air. The heat conducting capacity of the tubular body is not so great as to conduct the heat of combustion of the cigarette through the walls of the body at a rate sufficient to cause the external surfaces of the body to become heated to an extent which might cause burns to a smoker handling those external surfaces. By conducting the heat of combustion away from the ignited end of the cigarette and restricting the free flow of combustion supporting air to the ignited end of the cigarette the extinguisher functions to extinguish the cigarette in approximately 10 to 30 seconds unless a smoker draws on the outwardly projecting end of the cigarette remote from the ignited end thereof.

4 Claims, 4 Drawing Figures

CIGARETTE MOUNTED EXTINGUISHER

BACKGROUND OF THE INVENTION

1. Field of the Invention

This invention relates to a cigarette extinguisher and more specificially to a lightweight cylindrical body which is snugly telescopingly receivable over the ignited end of a cigarette and which will extinguish the cigarette in a predetermined period of time in the event a smoker fails to draw on the mouthpiece or filter end of the cigarette.

2. Description of Related Art

Various different forms of cigarette extinguishing apparatuses including some of the general structural and operational features of the instant invention are disclosed in U.S. Pat. Nos. 1,121,300, 1,388,200, 1,517,142, 2,177,636, 2,371,445, 2,701,571 and 3,173,425. However, these previously known forms of cigarette extinguishers do not include the overall combination of structural features incorporated in the instant invention to provide an apparatus which will dependably extinguish a lighted cigarette in a predetermined period of time in the event a smoker fails to draw air through the cigarette.

One of the most critical problems confronting developers of cigarettes has been how to produce a cigarette designed to be automatically extinguished in the event a smoker fails to draw upon the cigarette. Such a safety feature is very desirable since cigarettes are the major cause of injuries and fire deaths in residentail dwellings. The National Fire Association has concluded that cigarettes provided the heat of ignition for over 35% of one and two fatality fires in the United States from 1971 to 1978. The Association further concluded that 16.9% of the fires were caused by cigarettes igniting upholstered furniture in living room areas and 15.5% of the fires were caused by cigarettes igniting bedding in sleeping areas.

In an effort to reduce the occurence of such fires, the National Fire Association and several other significant Fire Associations have endorsed a Cigarette Safety Act which would stipulate that all cigarettes and little cigars produced in the United State should self-extinguish within five minutes if left unattended. Cigarettes will normally burn for a maximum of 24 minutes if they are left unattended. As such, proponents for such a safety feature assert that hundreds of lives could be saved and thousands of costly fires could be prevented very year if a self-extinguishing cigarette were to become a reality.

The problems associated with developing a self-extinguishing cigarette are clearly illustrated and made evident by the state of the prior art.

In this respect, references made to U.S. Pat. No. 1,517,142, issued to Allman on Nov. 25, 1924, which discloses an early attempt at developing a combined cigarette holder and extinguisher which essentially consists of a mouthpiece having a passage therethrough and into which a cigarette is positionable for smoking. A separate cap member is provided which must be carried in a user's pocket for the like and which is insertable over the cigarette and frictionally engageable with the holder so as to distinguish the cigarette and totally encase the same whereby it might be smoked at a later time. In other words, the Allman device does not relate to a self-extinguishing cigarette holder and as such does not overcome the problems above discussed.

Another device for extinguishing a cigarette is to be found in U.S. Pat. No. 2,371,445, issued to Irvin on Mar. 13, 1945. The Irvin device consists of a cylindrical tube into which the fire end of the cigarette may be inserted when it is desired to extinguish the cigarette. The internal bore of the Irvin device is only slightly larger in diameter than a cigarette so that a close fit is obtained and small hole is provided to permit smoke to be emitted therefrom, without allowing sufficient amount of air to be directed into the interior of the device so that the cigarette may be extinguished from a lack of oxygen. Of course, this device is not related to a self-extinguishing cigarette, since once it is inserted over a cigarette, the cigarette will quickly go out and no means are provided whereby a smoker may continue to smoke his cigarette with the Irvin device attached thereto.

There has been developed at least one device which is attachable to a cigarette during smoking thereof and which permits a cigarette to be easily extinguished by a smoker if desired. In this respect, U.S. Pat. No. 2,701,571, issued to Dittrich on Feb. 8, 1955, discloses a tubular member having a mouthpiece into which a cigarette may be inserted for smoking. The tubular member completely surrounds the cigarette and at the same time is provided with a plurality of air inlet holes to support combustion associated with the cigarette. The Dittrich device is designed to prevent smoke from escaping from a cigarette through the accumulation of the same within the tubular member, whereby a smoker may draw upon the mouthpiece to pull smoke from the chamber into his lungs, while at the same time fresh air enters through the air inlet holes in the tubular chamber. A smoker may easily extinguish his cigarette by covering the inlet holes with his hand. However, as with the other above-discussed cigarette extinguishers, the Dittrich device is not self-extinguishing, i.e., a cigarette left unattended therein will continue to burn and thus this device also does not comprise operable means for affecting a self-extinguishing cigarette.

SUMMARY OF THE INVENTION

The general purpose of the present invention, which will be described subsequently in greater detail is to provide a self-extinguishing cigarette that has all the advantages of similarly employed prior art devices and has none of the above-described disadvantages. To attain this, the present invention provides for a lightweight tubular device which can be attached to a cigarette in a manner which does not interfere with the smoking thereof and which will serve to extinguish the cigarette in a predetermined length of time if left unattended. Specifically, the present invention comprises a tubular member into which the ignited end portion of a cigarette is insertable and which will not be sufficient to extinguish the cigarette if the mouthpiece or filter end thereof is drawn upon by a smoker without appreciable delay. On the other hand, the tubular member is such that if the cigarette is not drawn upon within a predetermined length of time, the tubular member will be effective, by restricting access to ambient oxygen and by heat transfer from the burning end of the cigarette to extinguish the same. The lightweight construction of the present invention is such as to not irritate a smoker or cause damage to a cigarette and no mouthpiece on the cigarette is necessary so that a smoker may continue to enjoy the feel of the filter or mouthpiece end of the cigarette in his mouth.

The main object of this invention is to provide a cigarette extinguisher which has all of the advantages of the prior art and none of the disadvantages thereof.

Another object of this invention is to provide a cigarettte extinguisher which is of thin, lightweight construction and which can be easily and economically manufactured.

Yet another object of this invention is to provide a cigarette extinguisher which will effectively extinguish a cigarette within a relatively short period of time if left unattended, but which will not hinder the smoking of the cigarette provided a smoker draws air through the cigarette at intervals closely spaced together.

A further object of this invention is to provide a cigarette extinguisher which permits the smoking of a cigarette without the use of a mouthpiece and which can be attached to each cigarette after the cigarette has been "lit" or permanently attached to each cigarette in a pack.

Yet another object of this invention is to provide a cigarette extinguisher which may be readily produced for cigarettes of various different dimensions.

A final object of this invention to be specifically enumerated herein is to provide a cigarette extinguisher in accordance with the preceding objects and which will conform to conventional forms of manufacture, be of simple construction and easy to use so as to provide a device that will be economically feasible, longlasting and relatively troublefree in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
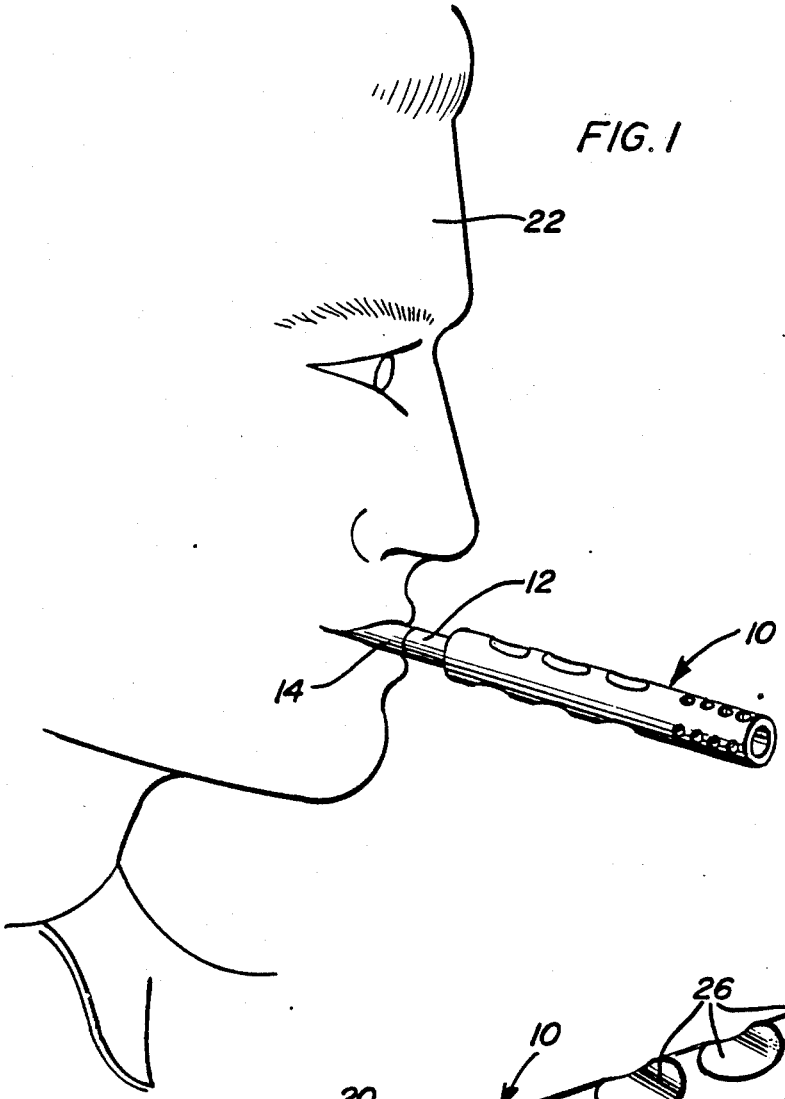
FIG. 1 is a perspective view of the extinguisher of the instant invention in operative association with a filter tip cigarette being held between the lips of a smoker.
Figure 4:
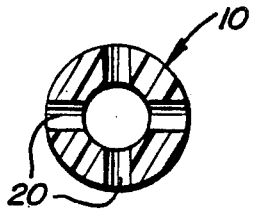
FIG. 4 is a transverse vertical sectional view taken substantially upon the plane indicated by the section line 4—4 of FIG. 3.

Referring now more specifically to the drawings the numeral 10 generally designates the cigarette mounted extinguisher of the instant invention. FIG. 1 illustrates the extinguisher 10 telescoped over the end of the cigarette 12 remote from the filter end 14 thereof and from FIG. 3 of the drawings it may be seen that the extinguisher 10 is slightly longer than the original length of the cigarette 12.

The extinguisher 10 includes a cylindrical body 16 defining a smooth longitudinal bore 18 extending therethrough and open at its opposite ends. In addition, one end of the bore 18 is flared as at 19 to facilitate longitudinal insertion of the end of the cigarette 12 remote from the filter end 14 thereof into the bore 18.

The end of the body remote from the flared end of the bore 18 includes circumferentially spaced sets of longitudinally spaced radial bores 20 formed therein and the body is constructed of a heat resistant material such as tetrafluoroethylene ("Teflon") having medium heat transfer capability.

In utilizing "Teflon" to construct the body 16 a lightweight extinguisher is provided and the life expectancy of the extinguisher 10 may be considered as considerable. Further, by utilizing a material in the construction of the body 10 which enjoys medium heat transfer capability, a reasonable amount of heat may be conducted through the body walls from the bore 18 to the external surfaces of the body 16. However, heat transfer is not so rapid and efficient as to cause the external surfaces of the body 16 to become excessively hot when a lit cigarette is disposed within the bore 18.

In view of the lightweight construction of the body 16, a smoker such as that illustrated at 22 in FIG. 1 may smoke the cigarette 12 in a normal and conventional manner without even realizing that the cigarette extinguisher 10 is supported therefrom. In this regard, no use is made of a mouthpiece for the body 10 so that the mouth engaging end of the cigarette may be directly inserted into the smoker's mouth thereby removing any semblance of artificiality which might be otherwise be associated with the use of the cigarette extinguisher 10.

Figure 3:
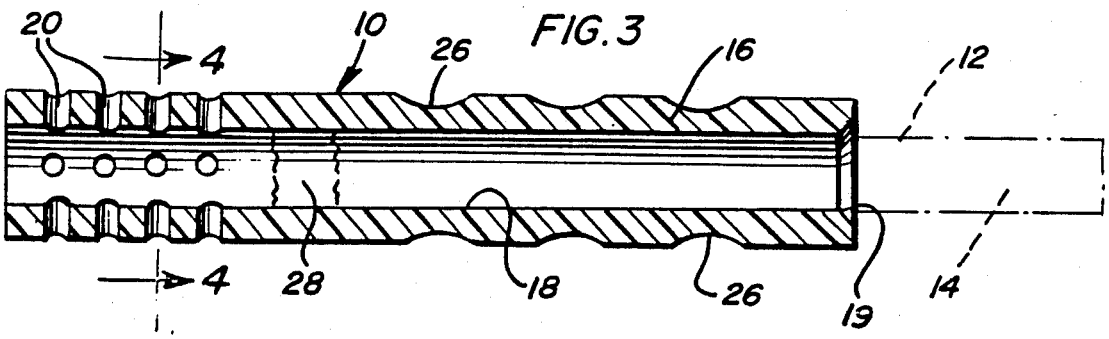
FIG. 3 is an enlarged longitudinal vertical sectional view taken substantially upon the plane indicated by the section line 3—3 of FIG. 2.

As clearly shown in FIG. 3, the radial bores 20 and the adjacent open end of the body 16 clearly provide ample access to combustion supporting air when the smoker 22 draws on the filter end 14 of the cigarette 12. When the smoker 22 ceases to draw on the filter end 14 of the cigarette 12 the bores 20 serve to allow smoke to escape from the interior of the body 16 and also to allow at least some combustion air to enter bore 18. This flow of smoke from the interior of the body 16 is accomplished by convection in an upward direction through the upward bores 20 and the admittance of fresh combustion air into the bore 18 is carried out through the lower bores 20. However, access to combustion supporting air is not so great as to allow the cigarette 12 to continue burning independent of an occasional draw on the cigarette 12 by the smoker 22.

Figure 2:
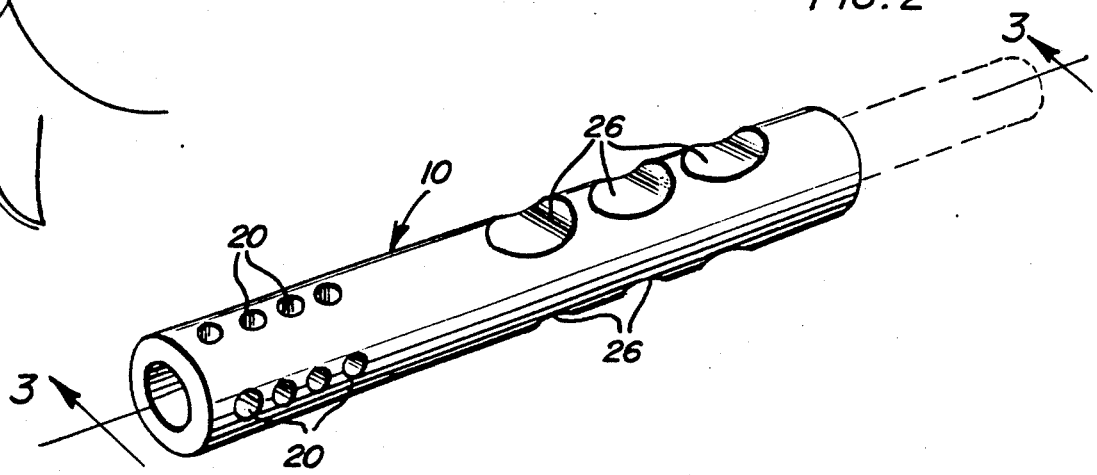
FIG. 2 is an enlarged perspective view of the extinguisher and with an associated cigarette being illustrated in phantom lines.

FIG. 2 illustrates in greater detail some of the structural features of the extinguisher 10. The extinguisher 10 includes longitudinally and circumferentially spaced indentations 26, also viewable in FIG. 3, to facilitate holding of the extinguisher 10.

In use, a smoker 22 need only to ignite his cigarette 12 and then slip the cigarette extinguisher 10 over the cigarette in the manner illustrated in FIG. 3. In this respect the ignited end 28 of the cigarette 12 is first positioned within the flared end of the bore 18 and then is forced through the bore 18 to a position approximate to the bores 30 and with only the filter tip or mouth engaging end 14 of the cigarette 12 projecting from the corresponding end of the body 16. A smoker may then commence to smoke the cigarette in a conventional and normal manner. The smoke generated by the cigarette 12 will typically be drawn therethrough into the smoker's mouth, while the apertures 18 as well as the open end of the body 16 permit an ingress of fresh air to support combustion. In the event a smoker waits too long to draw upon a cigarette 12, the restricted access to ambient oxygen accomplished by the body 16 and the medium heat transfer of the heat of combustion of the cigarette 12 from the surfaces of the bore 18 to the exterior surfaces of the body 16 will be sufficient to extinguish the cigarette 12 after a reasonable predetermined length of time. If, however, the smoker 22 draws on the cigarette 12 before that predetermined time expires, sufficient air for support of combustion is drawn through the ignited end of the cigarette 12 and reestablishes combustion thereof.

Inasmuch as the body 16 comprises a medium heat sink for the ignited end of the cigarette 12 but does not excessively conduct the heat from the surfaces of the bore 18 to the external surfaces of the body 16, the extinguisher 10 may be handled even immediately after a cigarette has been extinguished therein without the person handling the extinguisher 10 experiencing excessive heat by touch contact with the extinguisher 10.

A principal advantage of this construction resides in the fact that should a smoker fall asleep or otherwise allow his cigarette to come in contact with a combustible surface, such as bedclothes, upholstery, etc., the cigarette will self-extinguish in a relatively short period of time thereby preventing the creation of a fire which might be injurious to people or property. Further, the medium heat transfer capability of the extinguisher 10 allows the extinguisher 10 to comprise a heat sink for the heat of combustion of the cigarette 12 without allowing the external surfaces of the extinguisher 10 to be heated excessively. Additionally, the cigarette extinguisher 10 forming the present invention allows a smoker to permit his cigarette to be self-extinguished, therby preserving the same for a future use. In other words, a smoker 22 may desire to smoke only a portion of the cigarette 12 and the present invention affords a means whereby the smoker may effectively save the unsmoked portion of a cigarette for a later use.

It should be noted that the drawings, as provided herewith, illustrate the present invention in an enlarged manner so as to clearly illustrate the same. However, the actual construction of the present invention will comprise a reasonably thin and lightweight device so as to be almost unnoticeable by a smoker during a use thereof. In fact, it is conceivable that the lightweight and economical construction of the present invention would permit cigarettes to be sold in packages wherein the cigarettes are already encased within cigarette extinguishers. In this case, in order to initially ignite a cigarette it may be possible to ignite the cigarette through the open end of the body 16 remote from the filter tip end 14 of the cigarette 12.

Considering a typical embodiment of the cigarette extinguisher 10, the extinguisher 10 might be so designed to extinguish a cigarette in approximately 11 seconds should a smoker fail to draw on the cigarette. However, the heat sink capability of the extinguisher 10 could be sightly reduced or increased to lengthen or shorten, respectively, the amount of time required to automatically extinguish a cigarette.

It will be noted that when the cigarette 12 is initially ignited and immediately inserted within the body to the position thereof illustrated in FIG. 3, the ignited end 28 is spaced inward of the radial bores 20. In this regard, the time period required for the extinguisher and lack of free flow of combustion supporting air to the cigarette 12 during periods that the smoker 22 does not draw upon the cigarette 12 gradually shortens from approximately 30 seconds to approximately 10 seconds as the cigarette 12 becomes shorter. This is due to the fact that as the ignited end 28 of the cigarette 12 burns further inward of the radial bores 20 the ignited end is progressively greater shielded against access thereto by combustion supporting oxygen.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a cigarette of a given length and diameter and including a first ignited end portion and a second smoker's lips engagable end portion, a cigarette extinguisher comprising an elongated open ended tubular body defining a central longitudinal bore extending therethrough, said first end portion of said cigarette being ignited and lightly frictionally telescoped into said bore from a first end of said body to a position with said first end portion of said cigarette spaced inward from said second end of said body and said second end portion of said cigarette projecting outward of said first end of said body for engagement by the lips of a smoker, said extinguisher body including means incorporated therein for extinguishing said cigarette in approximately 10 to 30 seconds when said cigarette is not drawn upon by a smoker with sufficient frequency and at a sufficient rate, said means including circumferentially and longitudinally spaced generally radial bores formed in said second end of said body, only, spaced along said body from said ignited end portion away from said first end of said body and opening inwardly into said longitudinal bore and outwardly of the outer surface of said body and a radial wall thickness of said body and a material of which said body is constructed having heat resistance and medium heat conducting capability such that the heat of combustion of the first end portion of the cigarette in said longitudinal bore will be conducted away from said ignited first end portion of said cigarette in both directions extending along said body and the availability of combustion supporting oxygen from the ambient air to said ignited end portion of said cigarette will gradually decrease as said ignited end portion moves along the interior of said tubular body away from said second end of said body and radial bores toward said one end of said body.

2. The cigarette and extinguisher combination of claim 1 wherein said body is constructed of tetrafluorethylene.

3. The cigarette and extinguisher combination of claim 1 wherein the exterior surface of said first end of said body includes exterior indentations to facilitate the holding of the extinguisher by a smoker.

4. The cigarette and exterior combination of claim 1 wherein the end of said central longitudinal bore opening outward of said first end of said body is outwardly flared.

* * * * *